US007029348B2

(12) United States Patent
Bauduin et al.

(10) Patent No.: US 7,029,348 B2
(45) Date of Patent: Apr. 18, 2006

(54) WAVE MOTION ABSORBING OFFLOADING SYSTEM COMPRISING A SLENDER MOORING BUOY

(75) Inventors: Christian Bauduin, Nice (FR); Jean-Loup Isnard, Vence (FR); Gilles Ballestra, Cagnes sur Mer (FR); Antoine Carrasco, Nice (FR)

(73) Assignee: Single Buoy Moorings, Inc., Marley (CH)

( * ) Notice: Subject to any disclaimer, the term of this patent is extended or adjusted under 35 U.S.C. 154(b) by 0 days.

(21) Appl. No.: 10/501,803

(22) PCT Filed: Jan. 23, 2003

(86) PCT No.: PCT/EP03/00698

§ 371 (c)(1),
(2), (4) Date: Jul. 20, 2004

(87) PCT Pub. No.: WO03/062043

PCT Pub. Date: Jul. 31, 2003

(65) Prior Publication Data

US 2005/0042953 A1 Feb. 24, 2005

(30) Foreign Application Priority Data

Jan. 24, 2002 (EP) ..... 02075287

(51) Int. Cl.
*B63B 22/02* (2006.01)

(52) U.S. Cl. ..... 441/4

(58) Field of Classification Search ..... 441/3–5; 114/230.1

See application file for complete search history.

(56) References Cited

U.S. PATENT DOCUMENTS

| | | | | |
|---|---|---|---|---|
| 3,407,416 | A * | 10/1968 | Brickhouse | 441/5 |
| 3,408,971 | A * | 11/1968 | Mott | 114/257 |
| 3,778,854 | A | 12/1973 | Chow | 9/8 P |
| 4,138,751 | A | 2/1979 | Kentosh | 9/8 P |
| 4,529,334 | A * | 7/1985 | Ortloff | 405/224.2 |
| 4,802,431 | A * | 2/1989 | Pollack | 114/230.13 |

FOREIGN PATENT DOCUMENTS

| | | |
|---|---|---|
| EP | 0907002 A2 | 4/1999 |
| NL | 7515095 | 6/1977 |
| NL | 8701849 | 3/1989 |
| WO | WO 99/62762 | 12/1999 |

OTHER PUBLICATIONS

International Search Report for PCT/EP03/00698.

* cited by examiner

*Primary Examiner*—Stephen Avila
(74) *Attorney, Agent, or Firm*—Chinh H. Pham

(57) ABSTRACT

The invention relates to a mooring buoy (6), comprising a submerged part (13) and a part extending above water level (11). The part above water level comprising a fluid outlet duct (24) for attaching to a vessel (7), the buoy being anchored to the seabed via substantially taut anchor legs (27, 28). A substantially horizontally oriented fluid transfer duct (15) being attached to a connector (17) of the buoy in a non-rigid manner. The buoy comprises a substantially vertical fluid duct (21) between the connector (17) and the outlet duct (24) and a mooring connector (9) for attaching to a mooring line (8) of the vessel, wherein the length (L) of the buoy is between 20 m and 70 m and the ratio of the diameter (D) of the lower part (13) of the buoy and the length (L) being below 0.3, preferably below 0.2.

18 Claims, 10 Drawing Sheets

WAVE MOTION ABSORBING OFFLOADING SYSTEM COMPRISING A SLENDER MOORING BUOY

The invention relates to a mooring buoy for a hydrocarbon offloading system comprising a submerged part and a part extending above water level.

Such a hydrocarbon offloading system is known from FR-A-2 768 993. In this publication, an offshore platform or FPSO is connected to a mooring buoy having catenary anchor legs. The buoy is connected to the floating structure via a tension line comprising a compartmented tube having positive buoyancy. The tube supports hydrocarbon transfer lines and is attached on one end to FPSO whereas the fluid transfer lines are connected to the FPSO by a flexible line section. On the other side, the tension line is connected to the anchor leg of the buoy whereas the fluid transfer line is connected to the buoy via a flexible hose section. An excursion of the FPSO in any direction due to winds or currents, results in an excursion of the buoy of substantially the same amplitude. The distance between the buoy and the FPSO is maintained substantially constant whereas the submerged pipeline does not need to accommodate relative displacements between the buoy and the FPSO.

The known system has as a disadvantage that submerged pipelines of longer length will still be subjected to fatigue problems related to (local) compression and buckling of the fluid transfer line. The known fluid transfer line is connected to the tension member along its whole length, which tension member is part of the total mooring configuration. As a result, the fluid transfer line will be forced to follow the excursions of the buoy and the FPSO whereas the fluid transfer line itself does not contribute to the mooring system. The fluid transfer line has flexible hoses at each end and is not horizontally tensioned. This, in combination with the fact that the FPSO is relatively large and the buoy is small and have different (horizontal) motion behavior in view of their large size difference, leads to horizontal motions and variations in tension on the tension member, which motions will be directly transferred to the steel transfer line and which will create axial stresses as the ends of the steel pipe of the transfer line move in different manner. This results in local fatigue, compression and buckling of the transfer line. The known construction is unsuitable for transfer lines longer than 500 m and using a relatively large shuttle tanker moored to the relatively small buoy. In such case both floating constructions known from FR-A-2 768 993 will have more or less independent motions and excursions which can not be coupled with the vary long tension member, increasing the danger of slackening and buckling and compression of the pipeline.

Other systems using large steel pipes as offoading lines for deep water single point mooring terminals, reducing constant wave motion excitations imposed at the Single Point Mooring (SPM)-buoy and at the offloading risers is described in GB-A-2,335,723 and in U.S. Pat. No. 6,109,989. In these known mooring configurations, the fluid transfer lines are directly coupled to the buoy such that vertical and horizontal motions will be transferred directly to the risers, hence creating fatigue problems in the steel pipes resulting in a fatigue life which is too small for the required field (which is typically 25 times 10 or 250 years). Such fatigue problems arise when first order, wave induced high frequency motions of periods of about 10 s occur and cause relatively a small drift of a buoy moored in 1000 m water depth of around 3 m. Another fatigue problem for large steel risers is created by second order low frequency motions which could, at a water depth of 1000 m have periods in the range of 1–5 minutes and can cause a relative displacement of an order of magnitude of 400 m between the two floating bodies (so called slow drift motions).

In WO 99/62762 the problem of compression and buckling of the steel fluid transfer line is solved by a compliant submerged pipeline system wherein tensioning weights are added at the end parts of the horizontal pipeline resulting in a horizontal tensioning force on the pipeline ends and thus avoiding the danger buckling and compression.

It is an object of the present invention to provide a mooring buoy for an offloading system which is especially suitable for deep water in which wave motions on the buoy are minimized and fatigue problems near the connection of the substantially horizontal fluid transfer duct is reduced.

Thereto, the mooring buoy of the present invention comprises a submerged part and a part extending above water level, the part above water level comprising a fluid outlet duct for attaching to a vessel, the buoy being anchored to the seabed via substantially taut anchor legs, a substantially horizontally oriented fluid transfer duct being attached to a connector at or near the bottom of the buoy in a non-rigid manner, the buoy comprising a substantially vertical fluid duct between the connector and the outlet duct and a mooring connector for attaching to a mooring line of a vessel, wherein the length of the buoy is between 20 m and 70 m and the ratio of the diameter of the lower part of the buoy and the length (L) being below 0.3, preferably below 0.2.

The design of the present buoy reduces fatigue loading of the mooring lines and in particular of the horizontal fluid transfer duct, connecting the buoy to a hydrocarbon producing structure, such as an FPSO, a semi-submersible or a surface floating structure. The present mooring buoy design reduces surge and sway motions, particular at the bottom end of the buoy to which the horizontally oriented fluid transfer duct is connected in a flexible manner. Particularly advantageous dynamic behaviour is obtained when the horizontal fluid transfer duct, which may be formed of steel piping, is extendable in its length direction by having a curved trajectory, for instance a U-shaped, lazy W, or other curved configuration.

By the length of the buoy, the horizontal fluid transfer duct extends below the wave active zone. The buoy according to the present invention, preferably, does not comprise any structural additional weight, such as solid ballast weight, such that the anchor legs and the horizontal fluid transfer ducts provide the buoy stability. A ballastable compartment may be provided according to one embodiment to provide for the possibility of selectively trimming the buoy and adjusting the tension on the anchor legs, and hence the stiffness of the mooring system. The angular restoring force of the anchor lines on the buoy is very small compared to the restoring force of the buoyancy of the buoy. Connection of the anchor legs at or near the bottom of the buoy, maximises the lever arm of the buoy in sea.

In one embodiment, the buoy comprises an upper and a lower section, the upper section being connected to the lower section via a bearing, substantially below water level. In this case, a weathervaning upper section is formed. A preferred embodiment comprises a mooring buoy having a rotatable head extending above water level of relatively large diameter and having additional buoyancy. The head may provide a turntable for the mooring connector such that a shuttle-tanker moored to the head can easily weathervane around the buoy. The relatively large buoyancy chamber of the rotatable head is above water level in normal offloading situations since the horizontal fluid transfer duct is filled with oil. Whenever the horizontal transfer duct is filled with water, for instance during installation, the large floating head of the buoy compensates for the extra weight created by the water in the horizontal transfer duct. The enlarged buoyant head of the buoy also fights against tilt movements of the slender buoy due to hawser pull of the moored vessel as in that case the reserve buoyancy of the head will be partially pulled under water.

In case the buoy is damaged, for example by undesired contact with an offloading tanker and is partially submerged, the enlarged floating head of the buoy will stabilize the buoy at the water surface.

Some embodiments of a mooring buoy for use in a deep water hydrocarbon transfer system will be described in detail with reference to the accompanying drawings. In the drawings.

Figure 1:
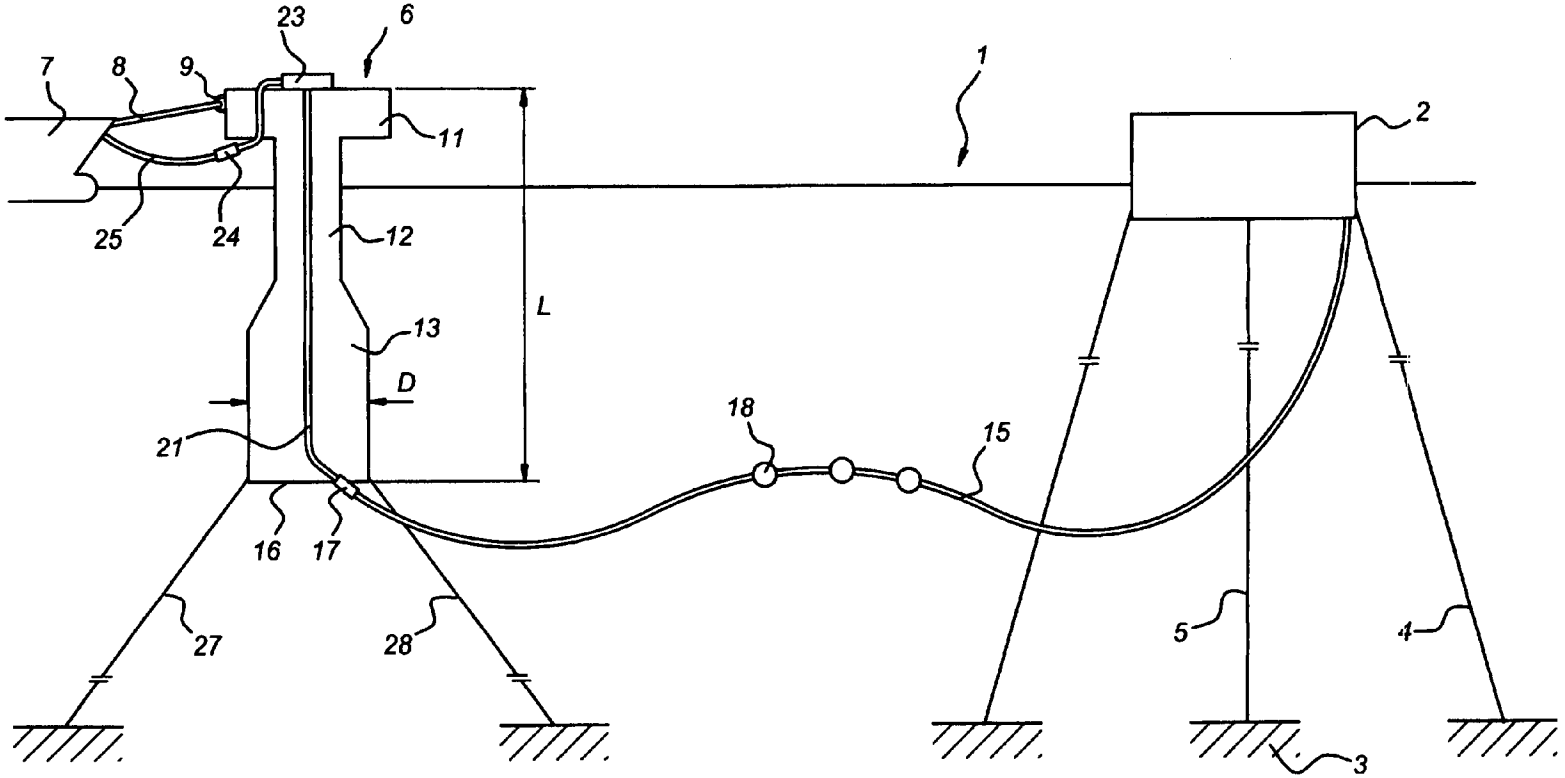
FIG. 1 shows a schematic view of a hydrocarbon offloading system of the present invention.

FIG. 1 shows a deep water hydrocarbon transfer system 1 comprising a production vessel, such as a FPSO 2, anchored to the seabed 3 via anchor legs 4. The FPSO may be connected to a hydrocarbon wellhead via a plurality of risers 5.

At the distance from the vessel 2, for instance several hundreds of meters up to several kilometers, an offloading buoy 6 is provided to which a tanker vessel 7 is moored via a hawser 8 and mooring connector 9. The buoy 6 comprises a part extending above water level including a rotatable head 11, connected to a slender upper section 12, and a broader lower section 13.

The offloading buoy 6 is connected to the vessel 2 via a mid depth steel transfer pipe 15 connected to the bottom 16 of the buoy via a flexible joint 17. The flexible joint connecting the steel transfer pipe to the buoy 6 may be located at a distance of up to ⅔ rds of the height of the buoy from the bottom 16. The steel transfer pipe 15 may have flexible pipe sections, such that it is extendable in its length direction in contrast to the taut and tensioned configuration shown in WO 99/62762. The length of the transfer pipe may be several hundreds of meters upto several kilometers. Buoyancy elements 18 may be provided to impart a lazy W configuration to the transfer pipe 15, resulting in a flexible transfer pipe, extendable in the length direction.

Drift of the FPSO 2 is thereby isolated from the offloading buoy 6 and is taken up by the transfer pipe 15 without causing a deflection of the buoy 6.

The length L of the offloading buoy 6 may for instance comprise 50 m, whereas the diameter D of the lower section 13 may comprise 9 m. The upper part of rotatable head 11 may extend about 7 m above water level, such that the dept of the transfer pipe 15 is about 43 m below water level.

The flexible connector 17 connects transfer pipe 15 to a vertical fluid duct 21 in the buoy, which is connected to a pipe swivel or torroidal swivel 23 at the rotatable head 11. To the swivel 23 a discharge duct 24 is connected for coupling to a flexible hydrocarbon transfer hose 25 of the tanker vessel 7. The buoy 6 is at its bottom 16 connected to substantially taut mooring lines 27, 28, which may be formed by polyester mooring lines attached to the seabed 3 via conventional anchoring means.

Figure 2:
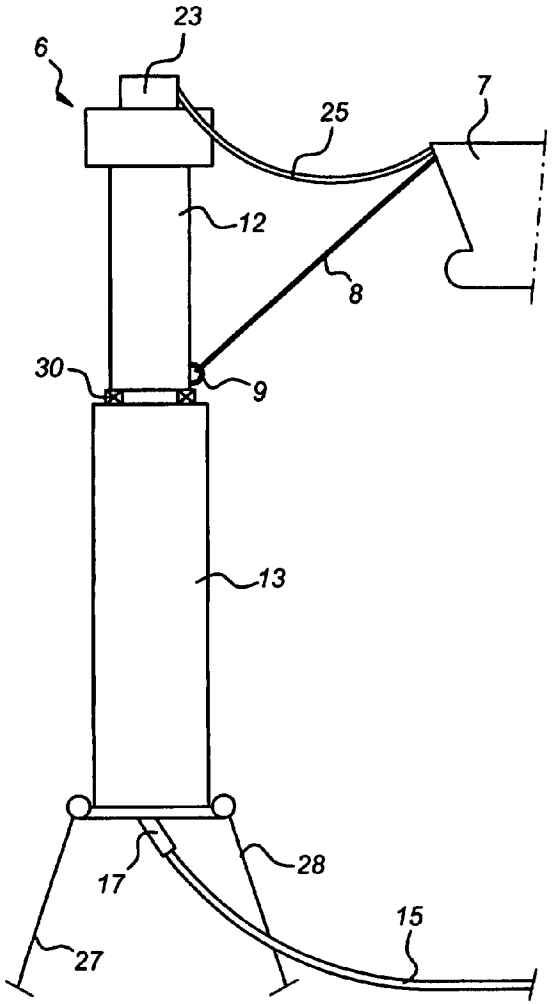

FIG. 2 shows an embodiment wherein the slender upper section 12 of the buoy 6 is connected to the broader lower section 13 via roller bearing 30. The mooring connector 9 is connected near the bottom of the slender upper section 12. Drift of the tanker vessel 7 will in this case result in a reduced tilting of the buoy 6.

Figure 3:
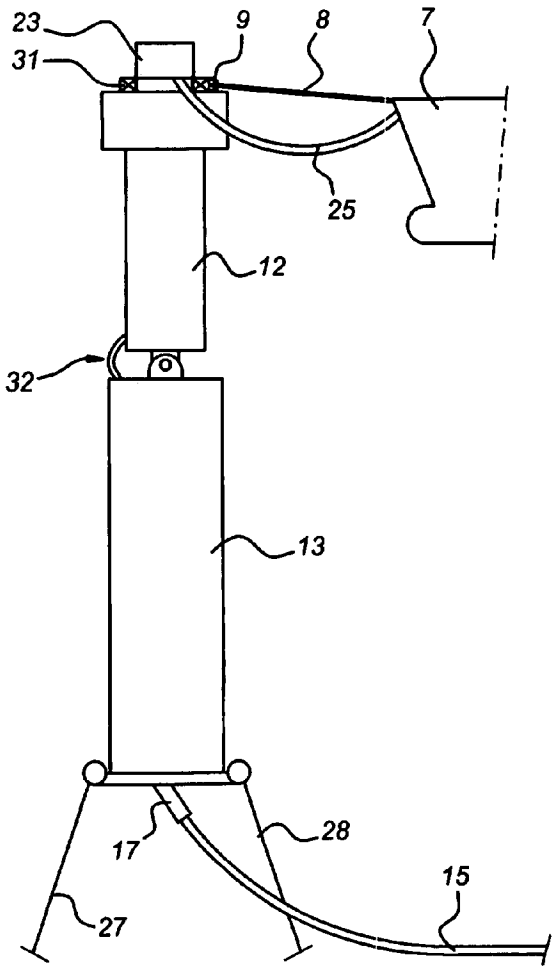
FIGS. 2 and 3 show embodiments of an offloading buoy in which an upper section is rotatingly and hingingly connected to a lower buoy section, respectively.

In the embodiment of FIG. 3, the mooring hawser 8 is connected to a turntable 31 at the top part 12. Drift of the vessel 7 is taken-up by a U-joint 32, causing the upper section 12 to pivot relative to stationary lower section 13.

Figure 4:
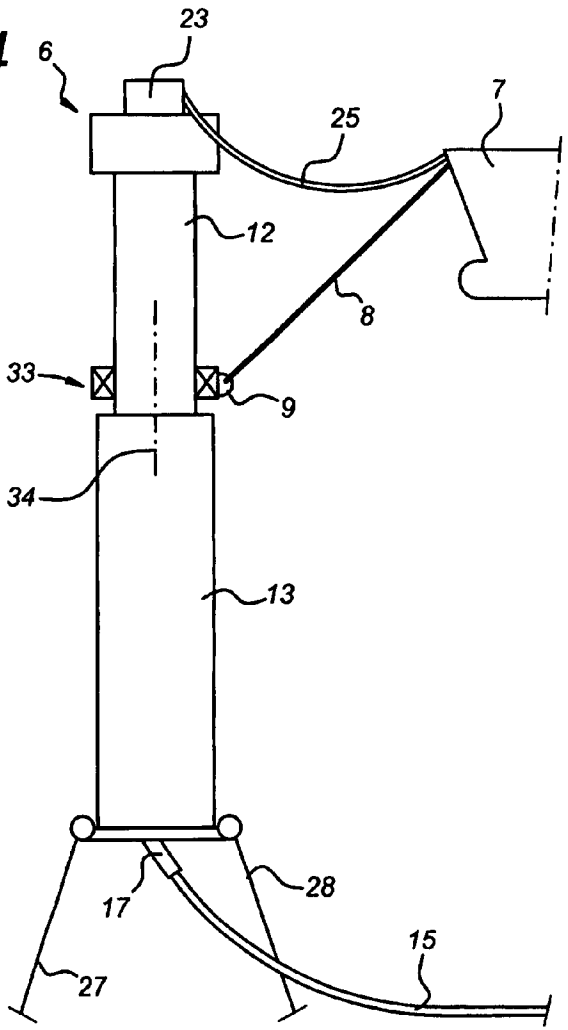

In the embodiment of FIG. 4, the mooring hawser is connected to a mooring connector 9, which can rotate via a bushing bearing 33 around a longitudinal centerline 34 of the buoy 6. The upper section 12 is fixed in rotation with respect to the lower section 13.

Figure 5:
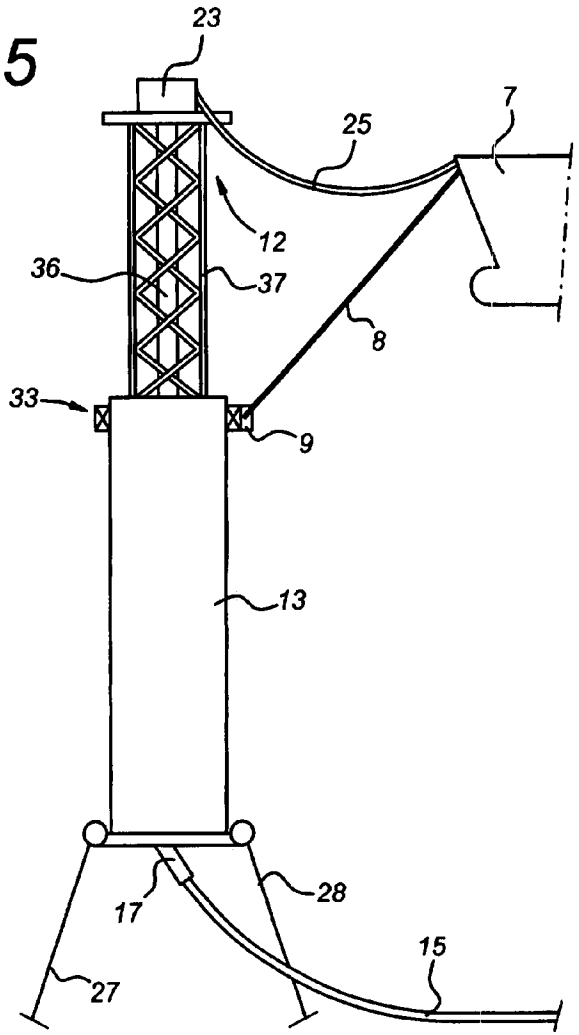
FIGS. 4 and 5 show embodiments in which a shuttle-tanker is moored to a mooring connector below water level rotatingly connected to the offloading buoy.

In the embodiment of FIG. 5, the upper section 12 comprises a central shaft 36 through which the vertical fluid transfer duct may be guided and an open frame 37. The open frame 37 is relatively insensitive to wave motions and offers reduced wave interaction.

Figures 6, 7, 8:
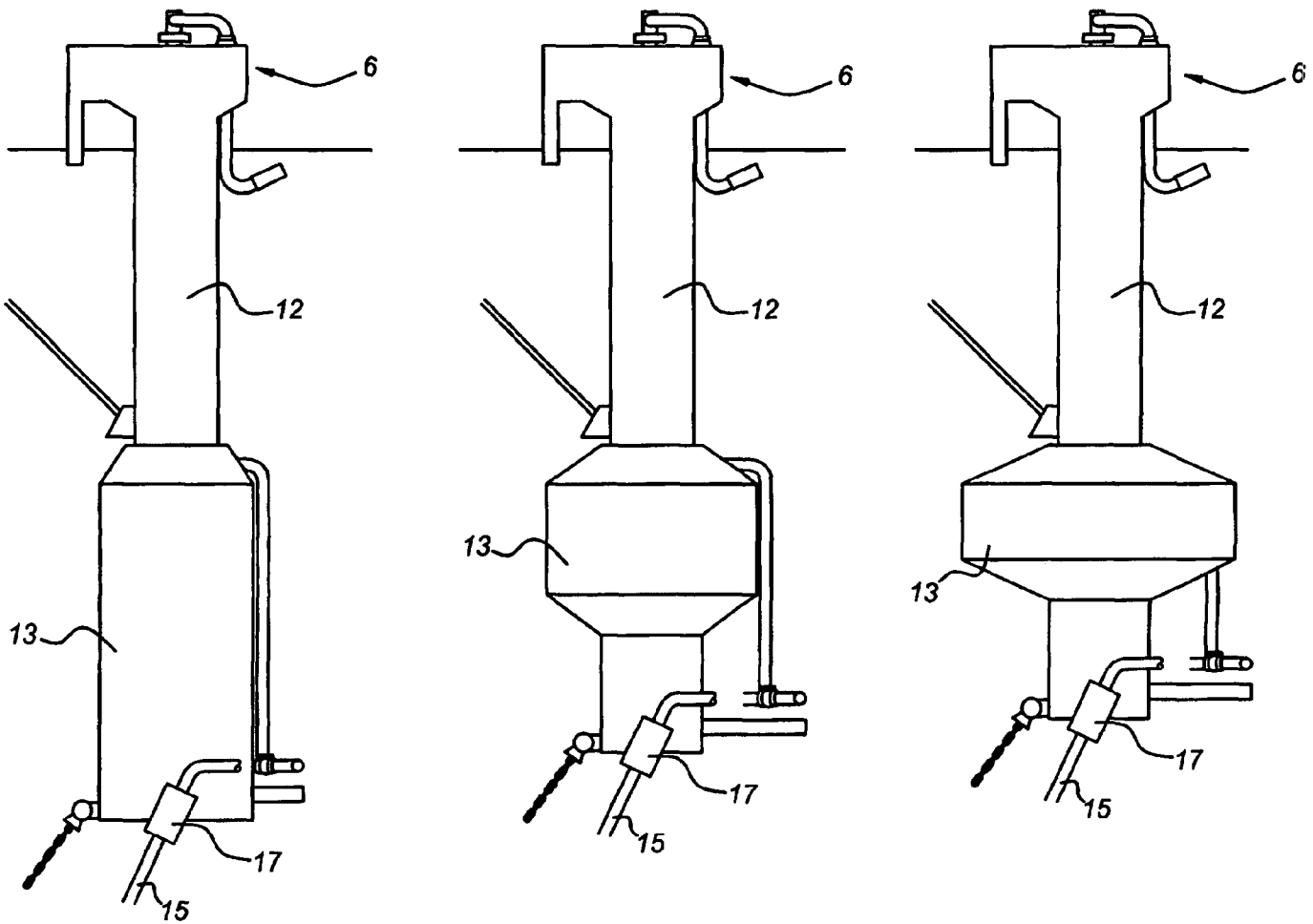
FIGS. 6–8 show different configurations of the lower buoy section.

FIG. 6-8 show different configurations of the lower section 13 of the buoy 6.

Figure 10:
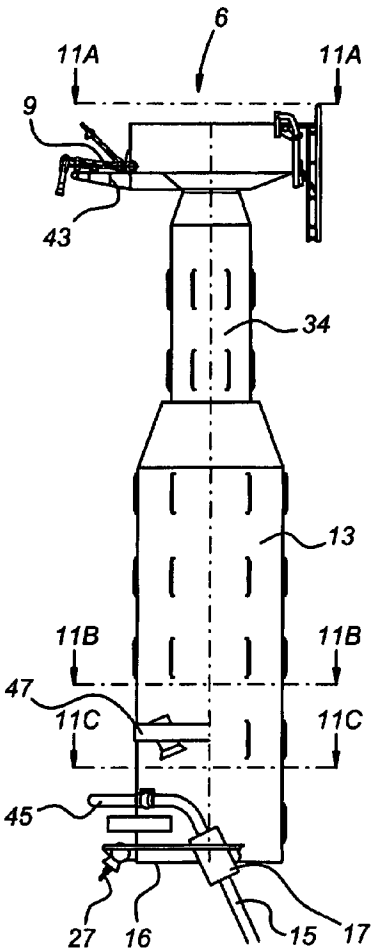
FIGS. 9–11 show a longitudinal cross-section, an elevational view and different cross-sectional views of an embodiment of a mooring buoy of the present invention having a rotatable head.
Figure 9:
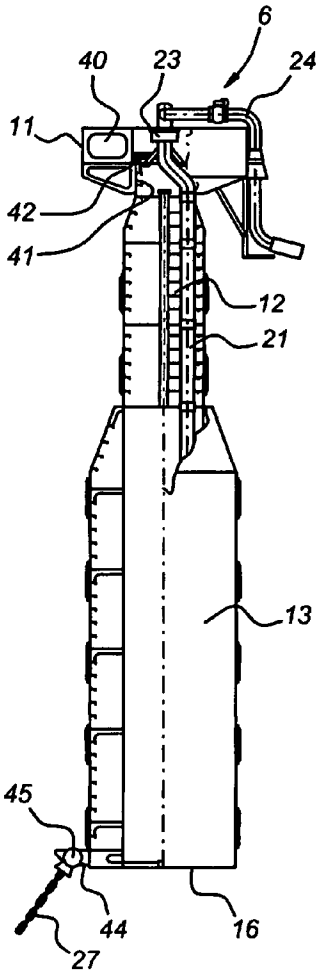
Figure 11A:
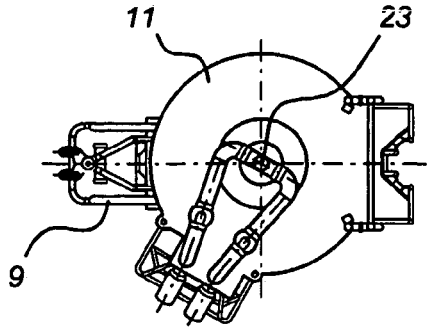
Figure 11B:
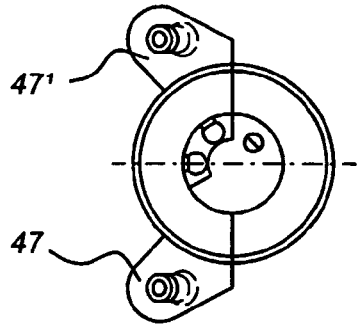
Figure 11C:
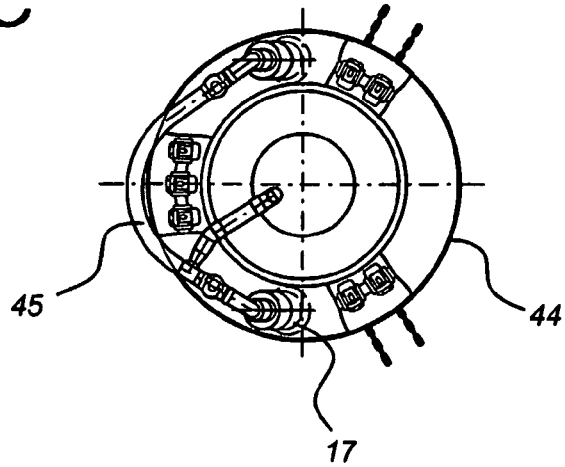

FIGS. 9 and 10 show an embodiment wherein the rotatable head 11 comprises a relatively large buoyancy chamber 40. The head 11 is connected to the central shaft 41 of upper section 12 through main bearing 42. Again, swivel 23 connects vertical fluid duct 21 to outboard piping 24, which connects to the tanker vessel via a floating hose.

As can be seen from FIG. 10, mooring connector 9 is placed on a arm 43 for providing a rotational moment on the rotating head 11 upon weathervaning of the tanker vessel 7.

The anchor lines 27 are connected at the bottom 16 of the buoy via a chain table 44, carrying chain hawse ratchet 45. As can be seen from FIG. 10, the connector 17 is connected to the chain table 44 from which the horizontal transfer duct is connected to the vertical fluid duct 21 via a pigging loop 45. Near the lower end of lower section 13, pulling machine supports 47 are provided for connection the fluid transfer line 15 to connector 17 for final product line hook-up.

Figure 12:
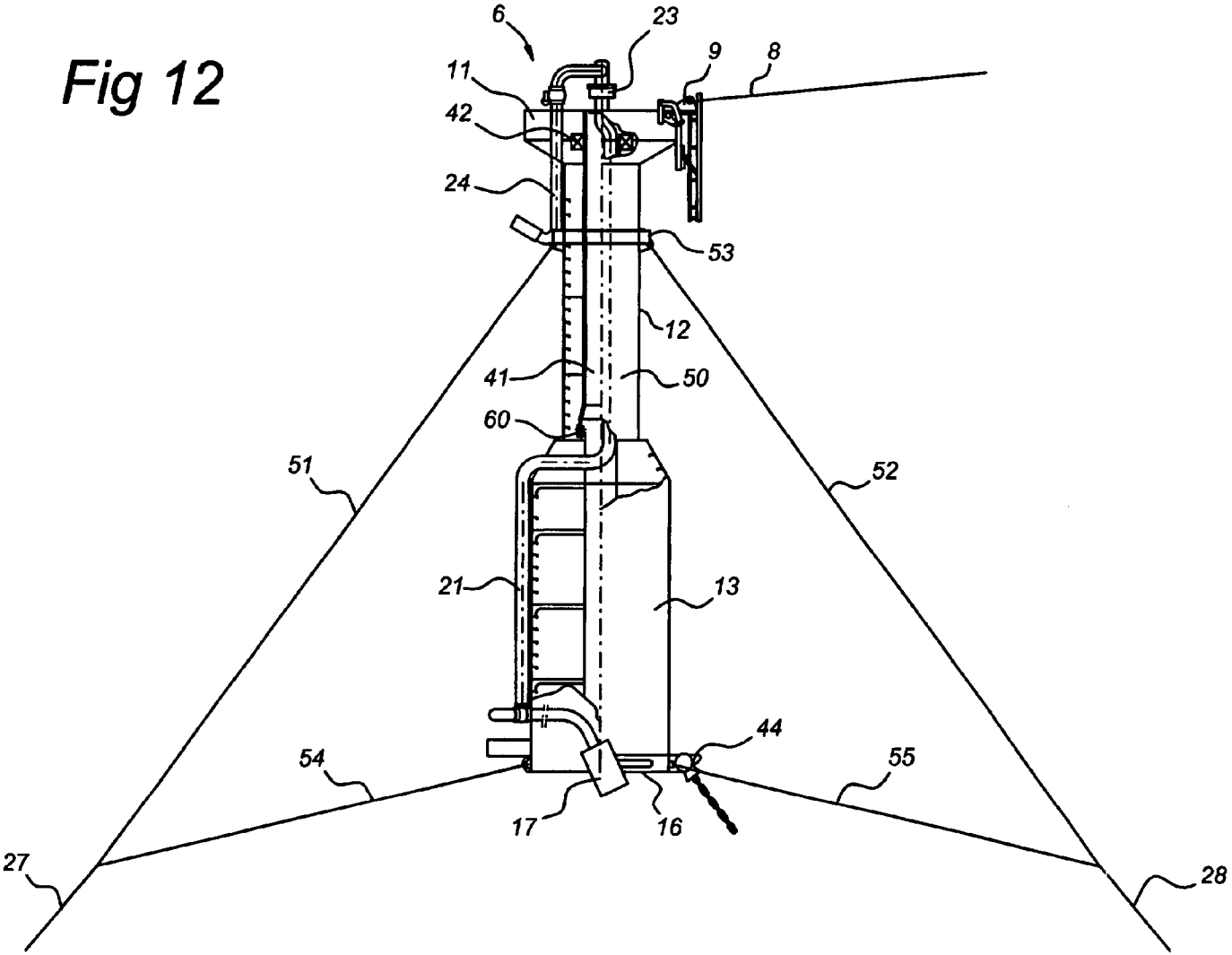
FIG. 12 shows an embodiment of a buoy comprising a rotatable upper section.

FIG. 12 shows an embodiment in which the vertical fluid duct along the lower section of the buoy 13 extends externally. The upper section 12 comprises a central shaft 41 around which a sleeve 50 is rotatably supported and connected near lower section 13 via slide bearings 16. The axial bearings 42 may be provided at the position of the broadened head part 11. The mooring hawser 8 is attached to connector 9 at the head part 11. The anchor legs 27, 28 comprise upper segments 51, 52 connected to a collar 53 at the upper section 12 of buoy 6. The lower segments 54, 55 of anchor legs 27, 28 are connected to chain table 54 near the bottom 16 of the buoy 6. The axial bearing 42 can be easily accessed for maintenance or repair above water level, whereas the frictional slide bearing 16, located below water level, will take up the horizontal forces on the buoy and can be exchanged or repaired when necessary in a more simple manner than axial bearings 42, which operation can be carried out below water level. Alternatively, axial bearing 42 can be placed at the position of chain table 44.

Figure 13:
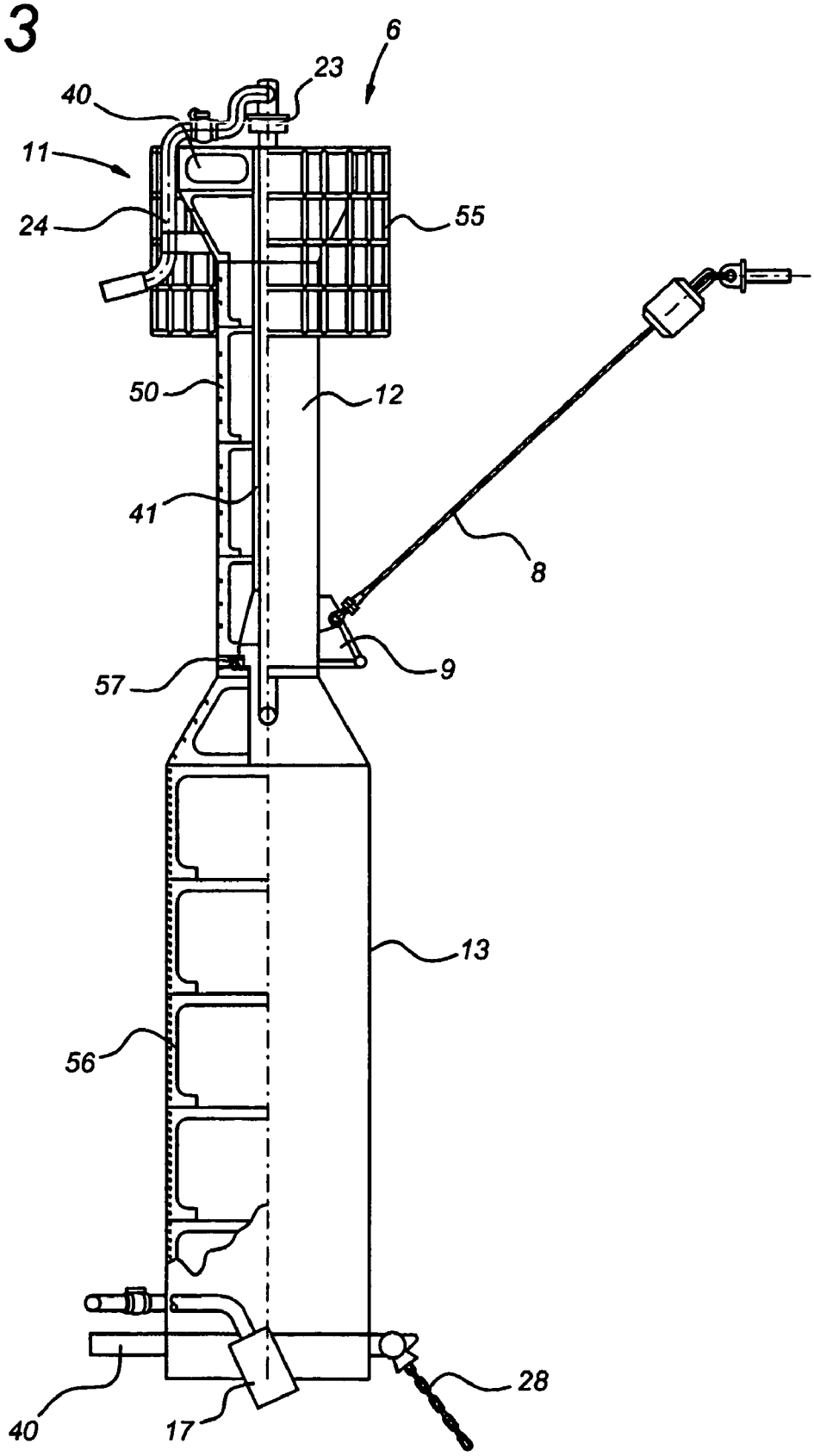
FIG. 13 shows an alternative embodiment of the buoy of FIG. 12 having a mooring connector near the lower end of the upper section.

FIG. 13 shows an embodiment of a buoy with a lower section 13 of a diameter of about 9 m and the upper section 12 of a diameter of about 4.5 m. The lower section 13 comprises ballastable compartment 56, whereas a fender system for preventing impact of the vessel with head 11 is provided at the upper section. The upper section 12 is rotatably connected to lower section 13 via axial/radial bearing 57.

Figure 14:
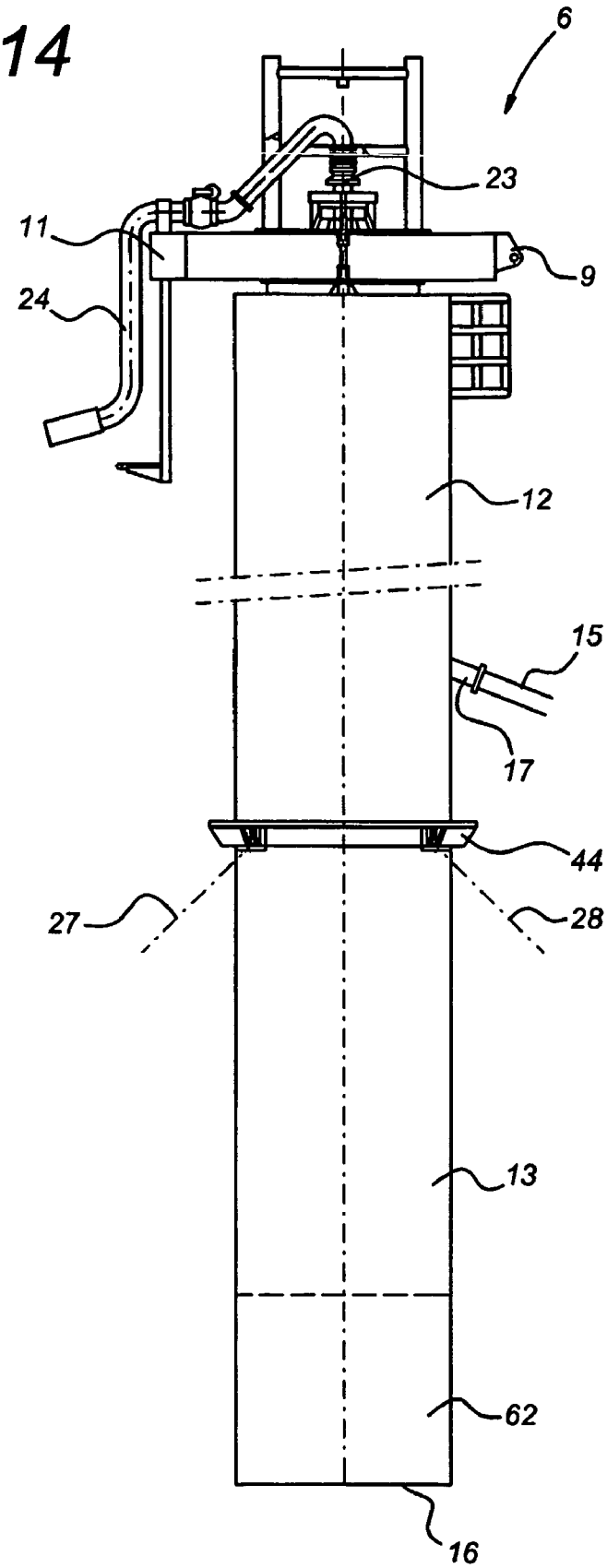
FIGS. 14 and 15 show alternative embodiments of a buoy of the present invention having a rotatable head and having anchor lines connected to a mid part and to a lower part of the buoy respectively.

In the embodiment of FIG. 14 the buoy 6 has a uniform diameter en comprises an upper section with a rotatable head or turntable 11 with the mooring connector 9. At the lower end of the buoy, a ballast tank 62 is provided. A chain table 4 extends some distance from the bottom 16 of the buoy. The connector 17 of the horizontal transfer duct 15 is attached at the lower section of the buoy, for instance not further away from the bottom 16 than ⅓ of the total length of the buoy.

Figure 15:
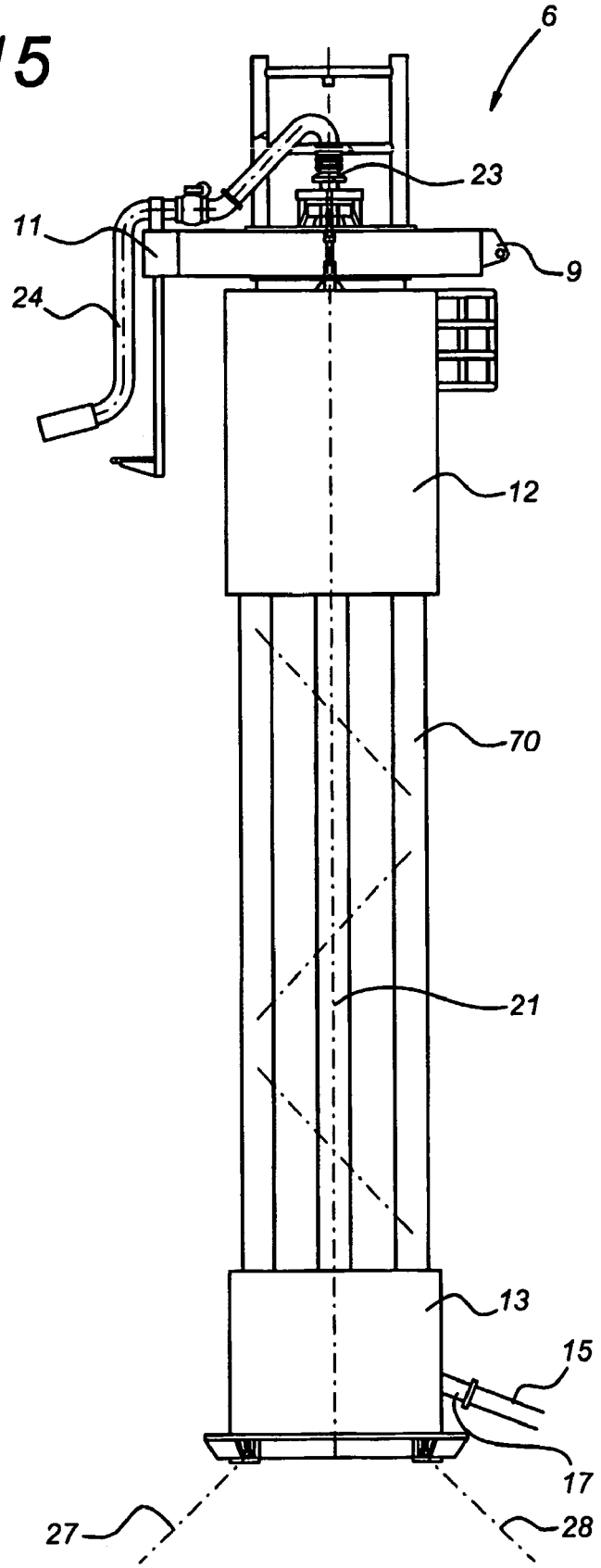

In the embodiment of FIG. 15, the vertical fluid transfer duct 21 extends in an open frame 70, connecting upper section 12 and lower section 13. The upper section provides increased reserve buoyancy.

The invention claimed is:

1. Mooring buoy (6) comprising a submerged part (12,13) and a part (11) extending above water level, the part above water level comprising a fluid outlet duct (24) for attaching to a vessel (7), the buoy being anchored to the seabed via substantially taut anchor legs (27, 28), a substantially horizontally oriented fluid transfer duct (15) being connected to a connector (17) of the buoy (6) in a non-rigid manner the transfer duct being a mid-depth transfer pipe, the buoy comprising a substantially vertical fluid duct (21) between the connector (17) and the outlet duct (24) and a mooring connector (9) for attaching to a mooring line (8) of the vessel (7), wherein the length (L) of the buoy is between 20 m and 70 m and the ratio of the diameter (D) of the lower part (13) of the buoy and the length (L) being below 0.3.

2. Mooring buoy (6) according to claim 1, wherein the connector (17) is located at or near a lower section (13).

3. Mooring buoy (6) according to claim 1, the connector (17) being located at or near the bottom (16) of the buoy (6).

4. Mooring buoy (6) according to claim 1, the lower section (13) extending to a distance below water level, an upper section (12) extending from the lower section (13) to above the water level, the upper section (12) having a diameter that is smaller than the diameter of the lower section.

5. Mooring buoy (6) according to claim 4, the upper section (12) being connected to the lower section (13) via a bearing (30, 57, 60).

6. Mooring buoy (6) according to claim 4, the upper section (12) being connected to the lower section (13) via a hinge joint (32).

7. Mooring buoy (6) according to claim 1, the buoy part above water level comprising a rotatable head (11) with a rotatable swivel (23) between the outlet duct (24) that is placed on the rotatable head (11) and the substantially vertical fluid duct (21).

8. Mooring buoy (6) according to claim 7, the rotatable head being of a larger diameter of the upper section (12) and having a buoyancy chamber (40).

9. Mooring buoy (6) according to claim 7, the rotatable head (11) being placed on a shaft (41) extending from the lower section (13) to above water level, the rotatable head (11) being connected to the shaft (41) via an axial bearing (42) above water level and via a slide bearing (60) at or near the lower section (13).

10. Mooring buoy (6) according to claim 1, the mooring connector (9) being placed at or near the lower part of the upper section (12).

11. Mooring buoy according to claim 10, the mooring connector (9) comprising a bearing (33), rotatable around a longitudinal axis (34) of the buoy.

12. Mooring buoy (6) according to claim 1, the mooring connector (9) comprising two connector parts at circumferentially space-aged locations.

13. Mooring buoy (6) according to claim 1, the substantially horizontally oriented fluid transfer duct (15) comprising at or near the connector a flexible joint.

14. Mooring buoy (6) according to claim 1, the substantially horizontally oriented transfer duct (15) comprising a steel piping.

15. Mooring buoy (6) according to claim 14, the steel piping extending along a curved trajectory, such as in a U-shaped, W-shaped configuration.

16. Mooring buoy (6) according to claim 1, wherein the connector (17) is placed at or near the attachment point of the anchor legs (27, 28) to the lower section (13).

17. Mooring buoy according to claim 1, the buoy comprising on its lower section ballast means.

18. Mooring buoy according to claim 17, wherein the ballast means is formed by a ballastable compartment.

* * * * *